United States Patent [19]

Barnes et al.

[11] Patent Number: 4,463,654

[45] Date of Patent: Aug. 7, 1984

[54] CONVERSION KIT FOR ASSAULT RIFLE AND CONVERTED RIFLE OF COMPACT CONFIGURATION

[75] Inventors: Thomas J. Barnes, Whittier; William H. Parry, Downey, both of Calif.

[73] Assignee: Armament Research Corporation of America, Downey, Calif.

[21] Appl. No.: 373,248

[22] Filed: Apr. 29, 1982

[51] Int. Cl.[3] ..... F41D 7/03; F41D 11/02

[52] U.S. Cl. ..... 89/128; 42/74; 89/132

[58] Field of Search ..... 42/71 R, 72, 75 A, 75 L, 42/74; 89/125, 128, 132, 136

[56] References Cited

U.S. PATENT DOCUMENTS

| | | | |
|---|---|---|---|
| D. 189,669 | 1/1961 | Leek et al. | D30/1 |
| D. 212,219 | 9/1968 | Crouch | D22/6 |
| D. 251,979 | 5/1979 | Hance | D22/6 |
| 713,254 | 11/1902 | Thorneycroft | 42/71 R |
| 1,290,855 | 1/1919 | Wesson | 42/75 C |
| 1,344,991 | 6/1920 | Cunningham | 42/71 R |
| 1,386,247 | 8/1921 | Fordyce | 89/136 |
| 2,970,398 | 2/1961 | Crouch | 42/69 |
| 3,611,607 | 10/1971 | Donnell | 42/1 |
| 3,611,872 | 10/1971 | Davis | 89/136 |
| 3,651,736 | 3/1972 | Ingram | 89/132 |

OTHER PUBLICATIONS

L. H. Brown, "Building the Bullpup Rifle," American Rifleman, May 1953, pp. 26–29.

*Primary Examiner*—Stephen C. Bentley
*Attorney, Agent, or Firm*—Natan Epstein

[57] ABSTRACT

An assault rifle is converted from an original to a modified configuration having a remote trigger located forwardly of the magazine by mounting a remote forward trigger to the original rifle by means of a pair of shroud pieces which cradle the rifle's receiver, replacing the original removable trigger of the assault rifle with a replacement lever, providing a cam element movable within cam guides defined in the shroud pieces and connecting the cam element to the remote forward trigger so as to move the cam into engagement with the replacement lever upon actuation of the remote forward trigger. The parts required for conversion are readily detachable from the rifle to thereby return the weapon to its original configuration.

27 Claims, 8 Drawing Figures

Fig. 1
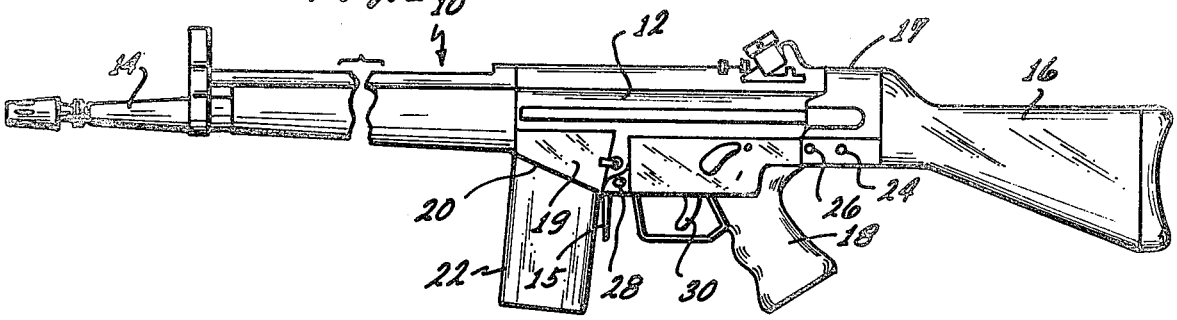
Fig. 2
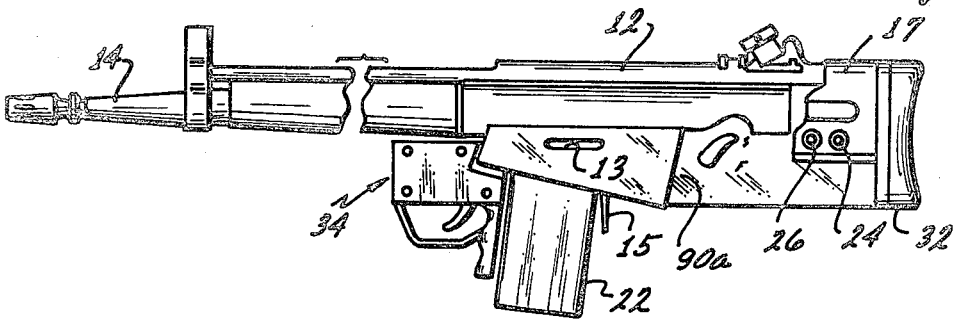
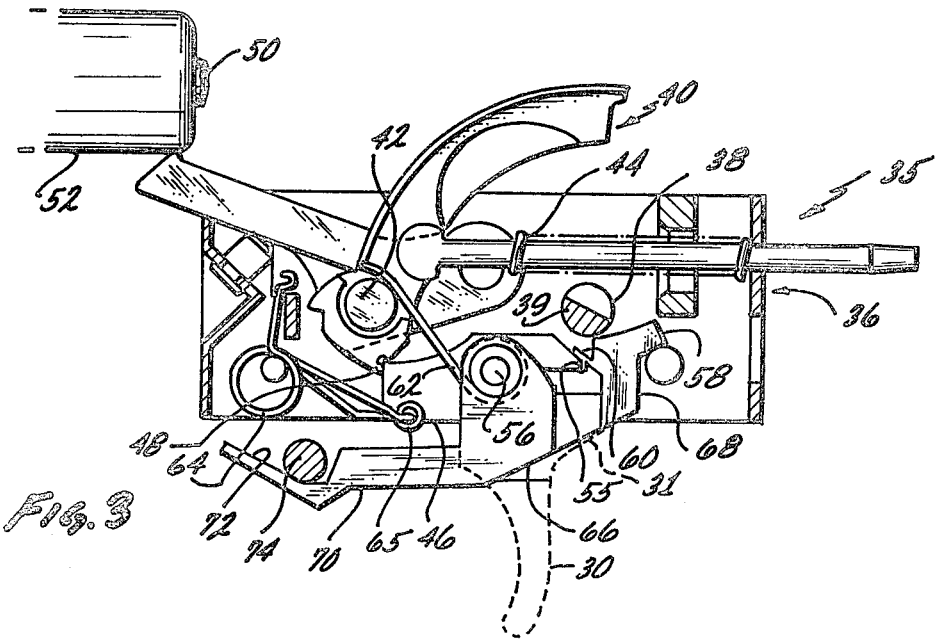
Fig. 3

CONVERSION KIT FOR ASSAULT RIFLE AND CONVERTED RIFLE OF COMPACT CONFIGURATION

BACKGROUND OF THE INVENTION

1. Field of the Invention

The present invention pertains generally to the field of fire arms and more particularly relates to a kit of parts for converting an assault rifle to a more compact configuration having improved handling characteristics and to the novel gun obtained by such conversion.

2. State of the Prior Art

The applicant is aware of the following prior art in connection with the presently disclosed invention.

U.S. Pat. No. 3,611,872 issued to Davis on Oct. 12, 1971 discloses a compact automatic rifle provided with a forward trigger mounted at the muzzle end of the gun and connected to the trigger-sear mechanism by a pair of cables which pass about opposite sides of the cartridge magazine.

U.S. Pat. No. 2,970,398 issued to Crouch on Feb. 7, 1961 discloses a shotgun converted by addition of a forward assembly and a single rod connecting the forward trigger to the original sear of the shotgun. The original trigger is removed in the conversion.

U.S. Pat. No. 1,386,247 issued to Fordyce on Aug. 2, 1921 shows a gun provided with a forward trigger assembly and a linkage rod directly connecting the forward trigger to the rear trigger. The connecting rod operates the rear trigger in a manner analogous to that of a finger, i.e., by pushing back on the trigger.

The applicant is further aware of the following design patents showing compact rifle or shotgun weapons distinguished by having the trigger mechanism mounted forwardly of the magazine or near the fore end of the receiver.

| U.S. Pat. No. | Patentee | Issue Date |
|---|---|---|
| Des. 251,979 | Hance | May 29, 1979 |
| Des. 289,669 | Leek et al | January 31, 1961 |
| Des. 212,219 | Crouch | September 17, 1968 |

The following patents are also made of record:

U.S. Pat. No. 3,651,736 to Ingram issued Mar. 28, 1972 and U.S. Pat. No. 3,611,607 and Donnell on Oct. 12, 1971

SUMMARY OF THE INVENTION

The present invention relates to a conversion of certain assault rifles and particularly concerns conversion of the German made Heckler and Koch G-3 series rifles as well as the Belgian FN-FAL rifles. These rifles have similar trigger mechanisms as well as certain other common features which enable conversion of either type of rifle in accordance to the present invention. Thus, while the description below primarily refers to the Heckler and Koch rifles and particularly to the H & K model 91, it is understood that the invention includes conversion of the aforementioned FN-FAL guns, as well as other makes of guns having appropriate original trigger mechanisms.

The Heckler and Koch rifles presently available include a number of variations such as the HK33, .233 caliber, with standard stock and the HK G-3 7.62 mm NATO caliber with standard stock. Civilian semi-automatic versions of the G-3 are also sold as the HK91A2 (standard stock) HK91A3 (retractable stock), as well as the HK91A2 and HK93A3. The military versions of the Heckler and Koch rifles are presently used by the armed forces of some 28 nations. The civilian models have also proven very popular, with an estimated 250,000 rifles in private hands in the United States alone. Since all the aforementioned HK models are variations on the basic H&K system and have similar trigger mechanisms and other features in common, the conversion disclosed herein is equally applicable to any of these models.

The present invention achieves an overall improvement in the handling characteristics of the rifle without otherwise affecting the normal operation and effectiveness of the weapon. In general, the shoulder stock may be replaced with a recoil pad and the trigger is moved from its original location behind the cartridge magazine to a remote position forwardly of the magazine, to thereby obtain a reduction in the overall length of the rifle. The rifle to be converted in its original configuration includes a receiver, a magazine well in the receiver, and a trigger group mounted in the receiver. The trigger group includes a spring driven hammer, a sear for locking the hammer in cocked position, and a original trigger pivotable for moving the sear to thereby release the hammer against a firing pin.

The conversion kit includes a remote trigger assembly including means for mounting the trigger assembly to the rifle at a location forwardly of the magazine well. A cam such as a cylindrical pin or roller is provided and connected to the remote trigger assembly by linkage members such that when the remote trigger lever is pulled, the cam is urged into camming engagement with a trigger lever which may be the original trigger unit in the trigger group of the rifle. Preferably, however,, the kit comprises a replacement trigger lever provided with a special camming surface. The replacement trigger lever is readily interchangeable with the original trigger and interfits with the sear in the same manner as the original trigger. The kit is assembled such that the cam can be urged into camming engagement with the camming surface when the remote trigger is pulled, causing the replacement trigger lever to pivot, thereby moving the sear out of locking engagement with the hammer and releasing the hammer against the firing pin. The kit may also comprise a pair of shroud pieces which cradle the receiver of the rifle and support the remote trigger assembly which is mounted between the two shroud pieces. The linkage members include a pair of preferably rigid transfer bars which are connected at their forward ends to the remote trigger assembly so as to be moved forward the remote trigger is pulled. The cam is supported between the rear ends of the transfer bars and is thus urged forward against the camming surface as a result of the remote trigger movement. The cam may be guided in its displacement by a pair of horizontal slots defined in the shroud pieces mounted to each side of the receiver. The transfer bars are shaped so as to extend along the sides of hte receiver but out of the way of the opening of the magazine well so as not to interfere with the normal insertion of cartridge magazines into the well. The transfer bars are protected by the shroud pieces and extend within a space defined between the receiver and the left and right shroud pieces.

In the interest of economy and a reduction in the number of parts required for the overall system, the original trigger of the rifle may be used in the remote trigger assembly when the replacement trigger lever is mounted in its place in the original trigger group in the receiver. The conversion may be completed by replacing the shoulder stock with a recoil pad which mounts to the back plate of the receiver and may also be secured to the rear ends of the shroud pieces to further secure these.

In this manner a novel rifle of compact configuration and having improved handling characteristics may be readily constructed by converting existing factory assembled rifles of proven performance and recognized quality. The conversion can be carried out readily and with minimal hand tooling. The field stripping capability of the rifle is not affected by the conversion and the converted weapon can be equally readily converted back to its original configuration.

The use of the transfer bar and cam arrangement approximates the leverage of the original trigger mechanism while at the same time producing a smoother acting and more readily adjustable trigger. The H&K rifles in particular, are known for a somewhat heavy trigger pull, in the range of 8 to 10 lbs., which is not adjustable in the original weapon. The remote trigger assembly of this invention, however, may include means for adjusting the pull force required for movement of the remote trigger.

The H&K rifles also have a normal center of balance which is located in the vicinity of the ejection port, a point forward of the pistol grip provided in the original rifle. The guns are therefore somewhat fore end heavy. Following the conversion the pistol grip is removed and the cartridge magazine serves as a grip or a palmer, so that the shooter's trigger hand is moved forward along the receiver to a point nearer the weapon's center of balance. The rifles converted according to the present invention are particularly suited for use in cramped quarters, such as by tank or aircraft crews, as well as for guard duty in embassies and the like. The converted rifle may be carried conveniently alongside the body, muzzle down and the recoil pad up against the armpit, the arm extended downwardly with the fingers curled around the front of the remote trigger housing. The weapon may be thus held only by the shooting hand and supported between the arm and the body of the person, the arm being relaxed except for the hand holding onto the trigger housing. The rifle may be brought to firing position simply by raising the arm to a horizontal position with the butt end of the weapon pivoting against the armpit and shoulder. Although the converted rifle is reduced in overall length, neither the operating characteristics nor the effectiveness of the rifle are impaired or in any way affected by the conversion so that the capabilities of a full size assault rifle are retained.

In the modified rifle of larger caliber, the size of the cartridge magazine does not lend itself to convenient use as a grip for most individuals. It may be more convenient to rest the palm of the hand against the side of the magazine while curling the third, fourth and fifth fingers of the shooting hand around the front of the magazine, with the index finger curling around the remote trigger. In the case of the smaller caliber weapons, e.g., the .233 models, the size of the magazine is small enough to allow convenient use of the magazine as a hand grip.

The component parts of the conversion kit are of simple and reliable design such that preformance and reliability of the weapon are not degraded. The kit components may be manufactured of a variety of materials and may include metal stampings, metal castings, machined metal parts as well as parts made of synthetic or composite materials including plastics or graphite composites.

A novel kit of parts is disclosed for conversion of an existing rifle to a new compact configuration having improved handling characteristics, by the novel method described herein.

BRIEF DESCRIPTION OF THE DRAWINGS

FIG. 1 is a side elevational view of a Heckler & Koch HK91 rifle in its original configuration, prior to conversion.

FIG. 2 is a side elevational view of the rifle of FIG. 1 following conversion. FIG. 3 is a section in elevation through the trigger mechanism of the rifle showing the replacement trigger lever in solid line superimposed over the original trigger in dotted lines.

DETAILED DESCRIPTION OF A PREFERRED EMBODIMENT OF THE INVENTION

Figure 4:
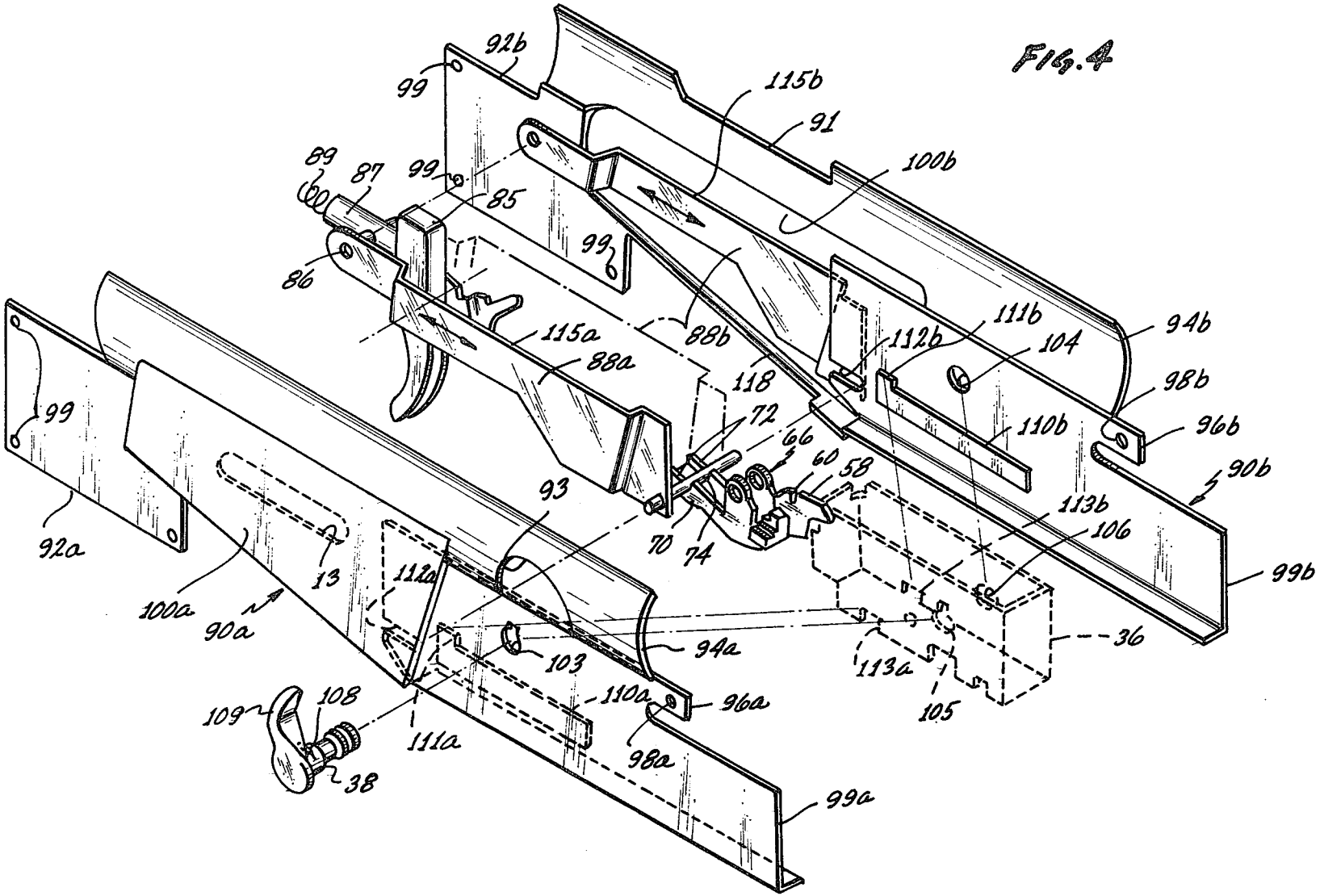
FIG. 4 shows an exploded view of the remote trigger mechanism and linkage to the cam arrangement between the two shroud pieces.

The H&K 91 rifle 10 illustrated in FIG. 1 in it original configuration includes a receiver 12, a barrel 14 attached to the fore end of the receiver, a shoulder stock 16 removably affixed to the rear end of the receiver, a pistol grip assembly 18 also removable from the receiver, and a magazine well 20 defined by a shaft 19, in which may be inserted a cartridge magazine 22. An optional quick magazine release lever 15 is also shown. The rifle illustrated is typical of the H&K weapons system in that it can be easily field stripped by removing certain retaining pins. For example, the shoulder stock 16 and the rear plate 17 can be separated from the receiver by removal of the two pins 24 and 26. Once the shoulder stock has been removed the rear end of the pistol grip assembly is freed and may be separated from the receiver upon removal of the locking pin 28. The grip assembly has mounted to its upper part the trigger assembly mechanism including the original trigger 30.

The rifle of FIG. 1 converted according to the present invention is illustrated in FIG. 2. As can be seen, the overall length of the rifle has been shortened considerably, primarily by removal of the shoulder stock 16. In its place, a recoil pad 32 has been secured to the rear of the receiver. The presently preferred method of attachment of the recoil pad is by threaded fasteners passing through the back plate of the receiver, originally used to hold the shoulder stock. These fasteners are accessible when the shoulder stock 16 and the back plate 17 are detached from the receiver 12. The back plate is then reattached to the receiver by means of the pins 24 and 26. A remote trigger assembly 34 is shown installed at a location forwardly of the magazine well. The magazine well is obscured in FIG. 2 by the shroud piece 90A, but lies above the cartridge magazine 22.

With particular reference to FIG. 3, the original trigger mechanism 35 includes a unitary case 36 within which the components of the trigger mechanism are mounted. The case is removable from the original pistol grip as a unit simply by extracting the safety-selector pin 38. The trigger mechanism includes a hammer 40 pivoted at 42 and driven by a coil spring/plunger assembly 44. The hammer 40 is shown in FIG. 3 locked in its cocked position. The hammer is retained in this position by engagement of the upper front edge of the sear 46 with the notch 48 of the hammer. The sear is movable by the trigger so as to depress the front of the sear 46 to thereby release the hammer 40 which is urged by the spring/plunger 44 against the firing pin 50 extending from the rear end of the bolt 52. The sear 46 is movable by the trigger 30, shown in dotted lines in FIG. 3. The original trigger 30 has an upper portion pivoted at pin 56. The pivot pin 56 extends through the case 36 and also extends through the sear 46. The trigger also includes a rearwardly extending portion 58 in which is defined a notch 60. The v-notch 60 cooperates with the safety pin 38 which may be rotated bewteen a Safe position and a Fire position. In the position shown in FIG. 3, the pin 38 is in the Safe position such that the solid portion 39 of the pin abutts against the trigger and locks the trigger against pivotal movement. When the safety pin 38 is rotated in a clockwise direction to a Fire positon, the notch receives a portion of the safety pin, allowing the trigger to pivot upwardly, and thereby moving the sear 46 out of locking engagement with the hammer 40. The trigger is urged towards a normal forward position by the trigger spring 62 while the forward end of the sear 46 is normally urged upwardly by the elbow spring 64 through the roller 65.

For purposes of conversion of the rifle it is preferred that the original trigger 30 shown in dotted lines in FIG. 3 be removed from the trigger mechanism 35 and replaced with a trigger lever 66 having the configuration shown in solid lines superimposed on the phantom line of the original trigger. The replacement trigger lever 66 may have an upper portion 68 substantially identical to that of the upper portion of the original trigger. Thus it is constructed to receive the original sear 46 which is removed from the original trigger and assembled with the replacement lever 66. Similarly, a rear portion 58 may be provided for cooperating with the pin 38 in the manner previously described. The replacement trigger lever 66, however, differs from the original trigger 30 in that it is provided with a forwardly extending arm 70. The arm 70 extends in a generally horizontal direction underneath the lower edge of the case 36. The case 36 supplied with the original rifle is open at the top and bottom and consists of four side walls in a rectangular arrangement, perforated at various locations for supporting the several pivot pins and other elements of the trigger mechanism. Thus, the replacement trigger lever 66 can be readily installed in the original trigger mechanism. Replacement is carried out by removing the pivot pin 38 which allows the original trigger to be withdrawn from the mechanism. The replacement lever 66 is directly interchangeable with the original trigger and is pivotally mounted on the same pivot pin 38. The relationship of the sear 46 to the hammer 40 and other elements of the trigger mechanism is not substantially affected by the exchange of trigger pieces. The relacement lever 66 has a camming surface or plane which in the embodiment illustrated in FIG. 4 is defined by two parallel edges on the upper side of the arm 70, preferably near the forward extremity thereof. Preferably the camming surface 72 lies at an angle such that its plane rises in a forward direction. A cam member 74 is disposed rearwardly of the camming surface 72 such that it can be brought into camming engagement with the surface 72 upon being displaced forwardly in a generally horizontal direction. For purposes of the conversion, the case 36 holding the trigger components is detached from the pistol grip structure 18 to which the trigger case was originally mounted. The pistol grip is not used in the converted gun. Instead the trigger mechanism 35 is mounted to the receiver in a manner that will be explained below.

Figure 5:
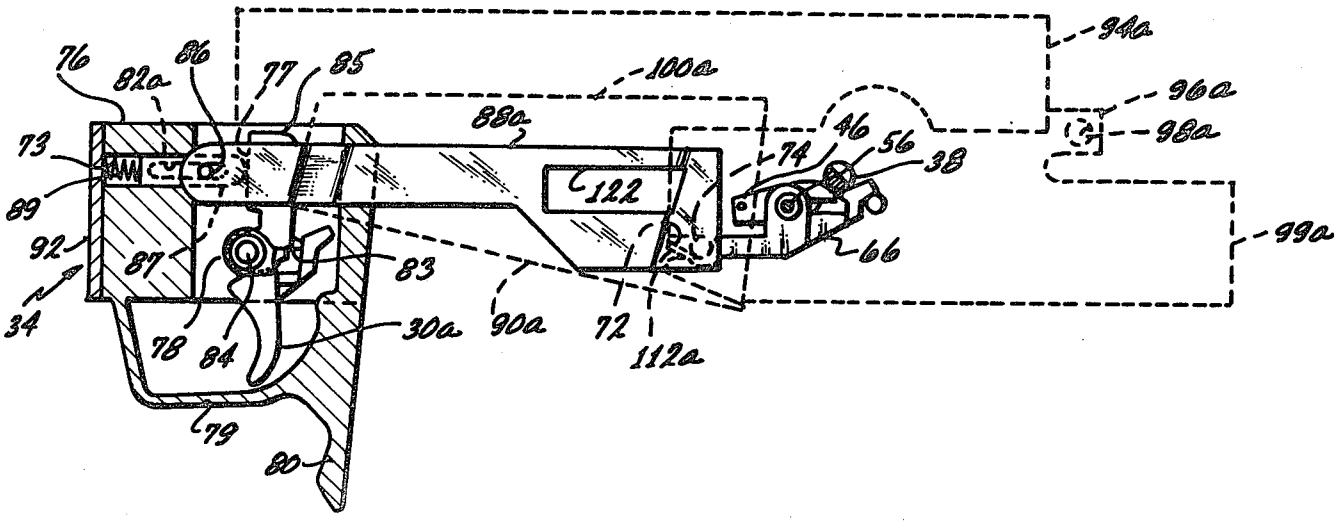
FIG. 5 is a side elevational section through the remote trigger assembly shown in section with a transfer bar connecting the remote trigger to the camming arrangement, and one shroud piece drawn in phantom line.

The remote trigger assembly, as shown in the cross section of FIG. 5, is seen to comprise a trigger frame or housing 76 which may be a unitary cast aluminum structure in which is defined an interior space 78 and which may further include a trigger guard 79 and a finger rest 80. The interior space 78 is closed laterally by a pair of side walls 81*a* and 81*b* which may also be integral with the main housing portion. Two aligned horizontal slots 82*a* and 82*b* are formed in the side walls 81*a* and 81*b*, which are further perforated for receiving a trigger pivot pin 84. A cross member which may be a cylindrical pin 86 is mounted for sliding movement within the aligned slots 82*a* and 82*b* of the trigger housing 76, such that the ends of the pin project outwardly beyond the side walls of the housing. The cross member structure may further include a cylindrical bullet shaped body 87 which has a rounded end facing rearwardly within the interior of the trigger housing. The body 87 is is slidable within a bore 73 and biased by a coil spring 86 mounted in compression between the body 87 and the front wall 92 of the trigger housing. The pin 86 may extend through the body 87 such that the pin is also urged rearwardly by the compressed spring 89.

Assembly of the remote trigger unit is completed by pivotably mounting a trigger unit on the pivot pin 86 in the interior space 78 of the trigger housing 76. In a preferred manner of practicing the invention, the original trigger 30 supplied with the original weapon as shown in FIG. 1 and in dotted lines in FIG. 3 is used as the trigger 30*a* in the remote trigger assembly. An extension piece 85 which may be of thickness similar to the sear 46 is assembled to the original trigger numbered 30*a* in FIG. 5 by passing the pivot pin 84 through openings in the lower end of the extension piece 85 which are aligned with the openings in the trigger. The lower end of the extension piece 85 also has a rear edge 83 which sits in the notch 55 shown in FIG. 3 which receives the rear end of the sear 46 in the original trigger assembly. The bottom portion of the extension piece 85 interlocks with the trigger 30*a* in such a manner that when the pin 84 is inserted through the aligned bores in trigger 30*a* and extension block 85 the two are rigidly interlocked. The housing 76 for the remote trigger may include openings at top and bottom to allow insertion of the trigger 30*a* and extension block 85 into the space 78. The extension block 85 has a frontal face 77 which is abutted by the rounded rear end of the cylindrical body 87 under the bias of the spring 89. The spring bias is transmitted to the trigger unit such that trigger 30*a* is biased to a normally forward position.

Figure 8:
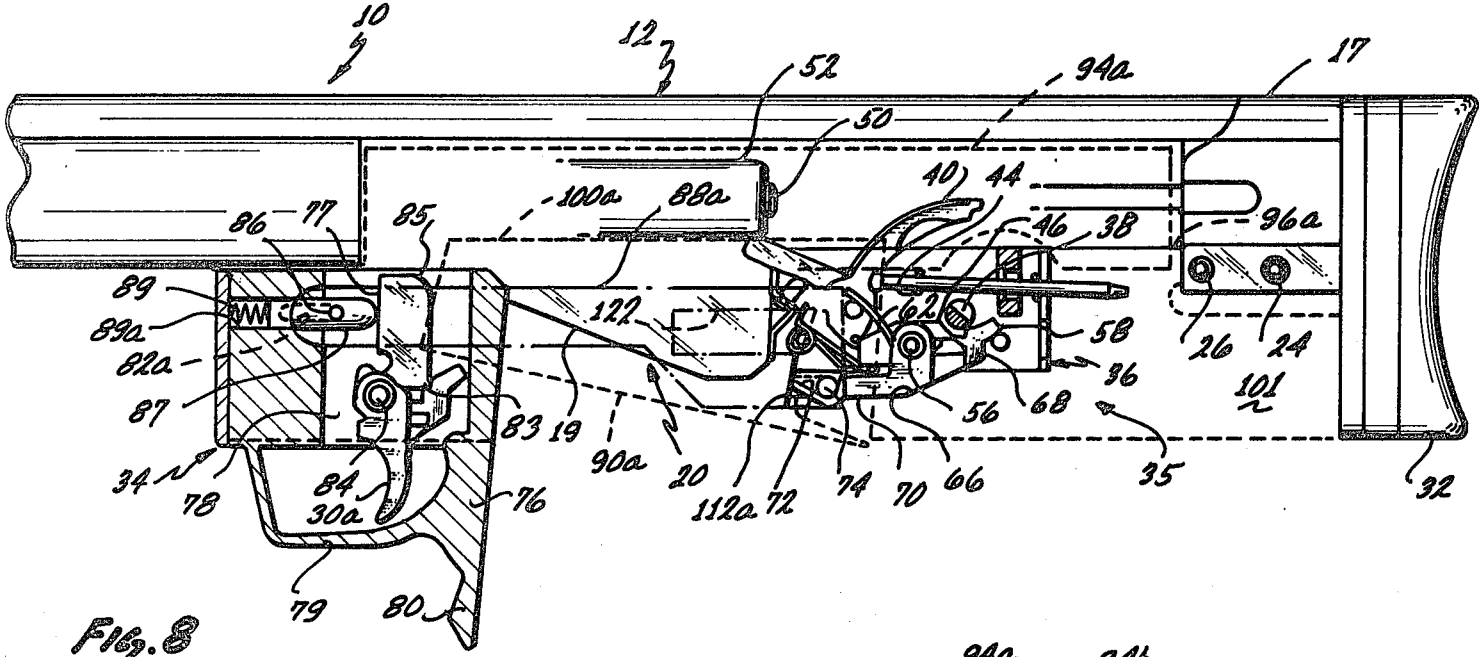
FIG. 8 shows in elevational section the remote trigger assembly, the transfer bars and the camming arrangement mounted to the rifle, and also showing the recoil pad attached to the rear plate of the receiver.
Figure 7:
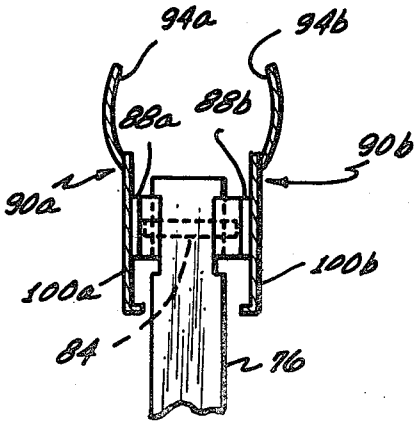
FIG. 7 is a vertical section taken along line 7—7 in FIG. 6.

The trigger housing is mounted intermediate a pair of shroud pieces 90*a* and 90*b*. The structure of the shroud pieces is best appreciated in the exploded view of FIG. 4. Each shroud piece is provided at its forward end with plate members 92*a* and 92*b* which may be perforated with holes 99 such that the side plates may be secured to the side walls 81*a* and 81*b* of the remote trigger housing 76, e.g., by means of threaded fasteners. The shroud pieces are further provided with upper portions 94*a* and 94*b* which are of cylindrical curvature closely conforming to the outer shape of the receiver 12 of the rifle to be converted. The receiver of the H&K 91 is generally cylindrical in shape and the upper portions 94*a* and 94*b* of the shroud pieces are curved to closely conform to the sides of the receiver. The shroud pieces further include rearwardly extending mounting tabs 96*a* and 96*b* which lie flat against the sides of the receiver and may be held captive between the receiver and the back plate 17 for securing the rear ends of the shroud pieces. The mounting tabs may be perforated at 98*a* and 98*b* to accommodate the locking pin 26 which retains the back plate 17 to the receiver 12 in the original rifle. The shround pieces extend rearwardly beyond the mounting tabs 96*a* and 96*b* and terminate in rear edges 99*a* and 99*b* respectively, which are flush with the recoil pad 32 as best seen in FIGS. 2 and 8. When assembled, the rear portions of the shroud pieces define an empty interior cavity 101 which may be used as a storage space if suitable access means are provided, such as hinged portion of the shround piece. The upper portion 94*b* of the right shroud piece 90*b* has a cutout 91 which is necessary to avoid obstructing the cartridge ejection port on the right hand side of the rifle's receiver. The left shroud piece 99*a* is provided with a semicircular cutout 93 which accommodaes the selector lever 99 when the safety pin 38 is inserted through the opening 103. If desired the left shroud piece may also be provided with an opening 13 which permits visual access to the serial number and other identifying indicia inscribed by the manufacturer on the left side of the receiver above the magazine well.

The shroud pieces desirably include intermediate trapezoidal portions 100*a* and 100*b* which define interior recesses in each shroud piece for accommodating the magazine shaft 19 and magazine 22 shown in FIG. 1. The space defined between the shroud pieces for the cartridge magazine is best appreciated in the horizontal section of FIG. 6, which shows a generally rectangular space 102 of enlarged width relative to the spacing between the front and rear portions of the shroud pieces. From FIGS. 5 and 6 it may be appreciated that the front portions of the two shroud pieces are secured in fixed spaced relationship by the remote trigger housing 76 fastened therebetween, while the rear ends of the shroud pieces are secured in a similarly spaced relationship by the mounting tabs 96*a* and 96*b* which are retained in an interference fit between the rear portion of the receiver and the back plate 17, and further secured by the locking pin 26. The trigger mechanism case 36 is mounted to one of the shroud pieces essentially in the same manner as previously mounted in the original rifle. That is, the case 36 is secured by the safety pin 38 to one of the shroud pieces. As illustrated in FIG. 4, the left shroud piece 99*a* has a keyed opening 103 which is aligned with a circular opening 104 in the opposite right shroud piece 99*b*. The trigger mechanism case 36 is originally provided with a keyed opening 105 which is aligned with an opposite non-keyed opening 106 in the opposite side wall of the trigger case. The safety/selector pin 38 as originally istalled in the rifle has a key tab 108 which indexes the pin such that it can only be inserted through the keyed openings 103 and 105 when the selector lever 109 is in a generally vertical position as shown in FIG. 4. Following insertion of the pin through the openings, it is possible to then rotate the lever 109 in a clockwise direction such that tab 108 will thereafter prevent withdrawal of the pin from the trigger case 36. The case is thus retained against the left shroud piece 99*a* by the safety pin 38. The case 36 is also secured against possible rotational displacement relative to the shroud pieces by supporting ridges 110*a* and 110*b* which may be defined by a pair of flat plates affixed to the inner surface of the shroud pieces. The supporting ridges support the lower edges of the trigger case 36 such that no rotation about the safety pin 38 is possible when the two shroud pieces are assembled to the receiver. The support ridges 110*a* and 110*b* may also comprise indexing tabs 111*a* and 111*b* dimensioned to interlock with the cutout portions 113*a* and 113*b* formed in the original trigger case 36 to facilitate positioning of the case during assembly with the shroud pieces and to further lock the case 36 against movement following assembly.

The shroud pieces further include portions defining slots 112*a* and 112*b* which extend generally horizontally along the inner side of the shroud pieces and are designed to receive the ends of the cam pin 74 so as to guide the movement of the cam in a horizontal path responsive to movement of the transfer bars in a manner indicated by the arrows in FIG. 4.

The remote trigger assembly is linked to the cam 74 by a pair of transfer bars 88*a* and 88*b* which extend closely adjacent to the left and right hand sides of the receiver 12 of the rifle. The transfer bars are connected at their forward ends to the cross pin 86 and at their rear ends to the cam pin 74. The side walls 81*a* of the trigger housing 76 may be grooved to provide a space between the trigger housing and the side plate for the front ends of the transfer bars to allow sliding movement of the transfer bars to the extent that the cross pin 86 is slidable within the slots 82*a* and 82*b* defined in the trigger housing.

When a pull force is applied to the lower end of the trigger 30*a*, as by a shooter's finger, the trigger assembly pivots causing the forward face 77 of the extension block to move forward urging the body 87 and the attached cross pin 86 in a forward direction thereby compressing the spring 89. The transfer bars are carried forward with the cross pin bar 86 thereby urging the cam 74 into camming engagement with the camming surface or plane 72 defined by the forward end of the horizontal path by the guide slots 112*a* and 112*b* formed on the inside of the shroud pieces. The forward displacement of the cam causes the forward end of the replacement trigger lever to be depressed and the trigger lever 66 pivots about the pin 56. This pivotal movement of the replacement tregger lever causes the sear 46 to be moved out of locking engagement with the hammer 40, releasing the hammer against the firing pin 50.

Figure 6:
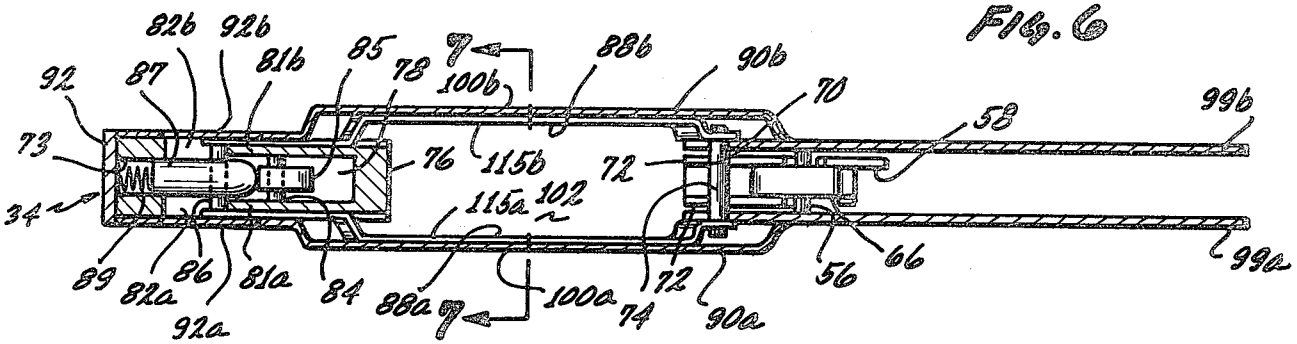
FIG. 6 is a horizontal section of the remote trigger, linkage and camming mechanism showing its disposition between the left and right shroud pieces.

In a preferred configuration, the transfer bars 88*a* and 88*b* are made of sheet metal and have co-planar forward and rear portions, while the middle portions 115*a* and 115*b* respectively are laterally displaced away from the receiver of the rifle so as to follow the contour of the magazine shaft and to define the enlarged rectanguar space 102 of FIG. 6. The intermediate portions 115*a* and 115*b* of the transfer bars are disposed within the recesses defined by the trapezoidal portions 100*a* and 100*b* of the shroud pieces, as is best appreciated in FIG. 6. The transfer bars extend downwardly at their rear ends and may be perforated for engaging the cam pin 74, as best seen in FIG. 8. The lower edge of the intermediate portion of the transfer bars is formed so as not to substantially interfere with the insertion of the cartridge magazines into the magazine well 20. In addition, the shroud pieces may be provided with inturned flanges 118 adjacent to the magazine shaft for better protecting the transfer bars and also guiding the insertion of the cartridge magazines into the magazine well. As will be appreciated, the transfer bars are fully protected by the shroud pieces and provide a simple but dependable link between the remote trigger assembly and the camming arrangement. Desirably, the transfer bars also include an opening 122 at the rear end as shown in FIG. 5, primarily for the purpose of accommodating the magazine release button which extends from the right side of the receiver. Such opening also helps reduce the overall weight of the converted weapon.

One possible sequence for carrying out the conversion is to secure the trigger case 36 to the left shroud piece 99*a* by means of the selector pin 38. The left shroud piece may then be secured to the receiver by sliding the mounting tab 96*a* into an interference fit under the back plate 17. The trigger housing 76 may then be affixed to the side plate 92*a* of the left shroud piece. The cross pin 86 may then be inserted into the opening provided therefor at the front end of the left transfer bar 88*a* and the rear end of the left transfer bar can be secured to the left end of the cam pin 74. The right transfer bar 88*b* may then be assembled to the phantom position of FIG. 4, with the front end being engaged to the cross pin 86 and its rear end being attached to the right end of the cam pin 74. The right shroud piece 90*b* is then ready to be mounted to the receiver by sliding the mounting tab 96*b* into an interference fit with the rear plate 17 and then securing the side plate 92*b* to the trigger housing 76. At this stage of the assembly the upper concave portions 94*a* and 94*b* of the shroud pieces lie on either side of the receiver 12 such that when the side plates are fastened to the trigger housing the concave portions 94*a* and 94*b* cradle snugly the receiver 12 and prevent substantial movement of the remote trigger assembly 34 and the trigger case 36 relative to the receiver.

It is contemplated that in a preferred embodiment of the invention, the conversion kit would be supplied without a new trigger for the remote trigger assembly and only an extension block would be included for assembly with the original trigger of the rifle. The kit may further include the housing unit for the remote trigger assembly, left and right transfer bars, a cam, the replacement trigger lever, and left and right shroud pieces. The remote trigger assembly would also be supplied with the cross pin, the bias spring, and the cylindrical bullet shaped body which is mounted to the cross pin connecting the forward ends of the transfer bars, as well as a pivot pin for mounting the trigger and extension block to the remote trigger housing. Desirably, the kit would also include a recoil pad for attachment to the rear plate of the receiver as well as to the rear end of the shroud pieces.

Preferably, the remote trigger housing is made of cast aluminum while the transfer bars may be formed of sheet metal. The shroud pieces can be fabricated from a variety of materials including plastics, graphite compositions, or metal plate stamped and welded to the proper configuration.

In an alternate manner of practicing the invention the original trigger 30 is retained in the trigger mechanism 36 and a new trigger is installed in the remote trigger assembly 34. The original trigger 30 has an inclined lower rear surface 31 which can serve as a camming surface. A cam such as a cylindrical roller may be mounted behind the surface 31 and slidingly retained in suitable guide slots formed, for example, in the shroud pieces. The cam roller is connected to the rear ends of the transfer bars so that the cam is urged forwardly into camming engagement with the surface 31 when the remote trigger is pulled. The resultant forces cause the rear of the trigger 30 is pivot upward, bringing down the forward end of the sear 65 which thus disengages from the notch 64 of the hammer. The hammer 40 is thus freed to strike the firing pin 50 under the force of the spring/plunger 44.

While a particular embodiment of the conversion kit and method of converting an existing rifle to a novel configuration have been described and illustrated, it will be understood that various changes and modifications are possible without departing from the spirit and scope of the invention as defined in the following claims.

We claim:

1. A rifle converted from an original to a modified configuration, the original configuration including a barrel, a receiver including a magazine well, a spring driven hammer, a sear for locking the hammer in cocked position and a removable original trigger lever pivotable for moving said sear to thereby release said hammer against a firing pin, said modified configuration comprising:

shroud means including cam guide means secured to opposite sides of said receiver;

remote trigger means mounted to said shroud means forward of said magazine well;

replacement lever means interchangeable with said original trigger and pivotable for moving said sear out of locking engagement with said hammer;

a camming surface on said replacement lever means;

cam means captive within said guide means and movable into engagement with said camming surface for pivoting said replacement lever; and linkage means extending along opposite sides of said receiver underneath said shroud means and operatively connecting said remote trigger means with said cam means for urging said cam means into engagement with said replacement lever means responsive to movement of said remote trigger lever;

said remote trigger means, said shroud means, said cam means and said linkage means being removable for returning said rifle to said original configuration.

2. The modified configuration of claim 1 wherein said linkage means comprise a pair of transfer bars extending along opposite sides of said receiver.

3. The modified configuration of claim 1 or claim 2 wherein said cam means comprises a cylindrical pin supported between said transfer bars.

4. The modified configuration of claim 2 wherein each said transfer bar is a generally planar member extending adjacent to the receiver above said magazine well without substantially interfering with the normal insertion of a magazine into said magazine well.

5. The modified configuration of claim 2 wherein said remote trigger means comprises a frame, mounting means for affixing said frame to said rifle, a remote trigger lever pivotably mounted to said frame, a trigger spring urging said trigger lever to a normally forward position, and a cross member connecting the forward ends of said transfer bars, said cross member being displaceable in a forward direction responsively to a pulling force on said remote trigger lever, whereby said cam means is urged forward into camming engagement with said camming surface to thereby move said sear and release said hammer.

6. The modified configuration of claim 5 wherein said remote trigger lever includes a trigger pivot axis, a lower finger portion extending below said pivot axis and an upper portion extending above said pivot axis.

7. The modified configuration of claim 5 or claim 6 wherein said remote trigger lever has separate interfitting upper and lower portions, the lower portion being the original trigger lever of said rifle prior to conversion and the upper portion being adapted to fit within the original trigger lever, and secured together by a pivot pin extending through aligned bores in said interfitting portions.

8. The modified configuration of claim 1 wherein said replacement lever means comprises a forwardly extending portion including an upper camming surface, said camming surface being disposed at an angle forwardly of said cam means such that said forward portion is depressed in response to forward movement of said cam means thus causing said replacement lever means to pivot and move said sear out of locking engagement with said hammer.

9. The modified configuration of claim 8 wherein said replacement lever means is replaceable by the original trigger lever such that said rifle may be converted back to an original configuration.

10. The modified configuration of claim 8 wherein said original trigger element is used as a removable portion of said remote trigger means.

11. The modified configuration of claim 1 wherein said shroud means comprise an interior shroud surface and said guide means are grooves formed on said interior surface on each side of the receiver and said cam means is a pin extending through said transfer bars and into said grooves at both ends.

12. The modified configuration of claim 11 wherein said shroud means comprise a left shroud piece and a right shroud piece mounted to the respective sides of the receiver.

13. The modified configuration of claim 1 wherein said rifle, in its original configuration has a shoulder stock said, converted configruation further comprising a recoil pad removably secured to the rear end of said receiver and interchangeable with the shoulder stock.

14. A conversion kit for use with a rifle of the type including a receiver, a barrel attached to said receiver, a magazine well in said receiver, a spring driven hammer, a sear for locking the hammer in cocked position and an original removable trigger pivotable for moving said sear to thereby release said hammer against a firing pin, said conversion kit comprising:

a remote trigger assembly attachable to the rifle forwardly of the magazine well;

replacement trigger lever means including a camming surface, said replacement trigger lever means being interchangeable with said original trigger for moving said sear;

a pair of linkage members each having a forward end operatively connectable to said remote trigger assembly;

a pair of shroud pieces mountable to the sides of the receiver of said rifle over said linkage members, said shroud pieces including cam guide means; and cam means mountable to the rear ends of said linkage members and captive within said cam guide means such that said cam means is urged into camming engagement with said replacement trigger responsive to actuation of said remote trigger assembly to thereby move said sear and release said hammer.

15. The conversion kit of claim 14 wherein said remote trigger assembly is attachable to said shroud means for mounting to the receiver of the rifle.

16. The conversion kit of claim 14 wherein said shroud means comprise a left shroud piece and a right shroud piece each attachable to the corresponding side of the receiver.

17. The conversion kit of claim 16 wherein said cam guide means comprise slots formed in said shroud pieces.

18. The conversion kit of claim 14 wherein said replacement trigger lever means includes a forwardly extending arm, said camming surface being defined near the forward extemity of said arm on the upper side thereof.

19. The conversion kit of claim 14 wherein said cam means is a cylindrical pin supported between said linkage members.

20. The conversion kit of claim 14 wherein said remote trigger means comprise a housing, pivot means for mounting a trigger to said housing, and means for operatively interconnecting said linkage means to such a pivotably mounted trigger.

21. The conversion kit of claim 20 wherein said remote trigger means further comprises means for biasing said remote trigger to a normally forward position.

22. The conversion kit of claim 20 or claim 21, further comprising a trigger for pivotal mounting to said remote trigger housing.

23. The conversion kit of claim 20 wherein said interconnecting means comprise:

an extension piece interlockable with the original trigger of said rifle for extending the trigger upwardly of said pivot point in said trigger housing;

cross member means movable within said trigger housing and attachable to said linkage means; and bias means urging said cross member means against said extension piece such that said cross member means is displaceable in a forward direction responsively to a pulling force applied to the trigger.

24. The conversion kit of claim 14 further comprising recoil pad means attachable to the rear of the receiver of said rifle interchangeably with an original removable shoulder stock on said rifle.

25. The conversion kit of claim 15 wherein said shroud means and said remote trigger means are mounted to the rifle by means of shroud portions cradling the receiver of the rifle and covering at least portions of said linkage members.

26. A method for converting an assault rifle of the type including a receiver, a barrel attached to said receiver, a magazine well in said receiver, a spring driven hammer, a sear for locking the hammer in cocked position and an original removable trigger pivotable for moving said sear to thereby release said hammer against a firing pin, to a compact configuration having improved handling characteristics, said method comprising the steps of:

replacing the original trigger with a replacement trigger lever having a camming surface;

attaching a pair of shroud pieces to opposite sides of the receiver of the rifle, said shroud pieces supporting a remote trigger assembly forwardly of the magazine well, said shroud pieces including cam guide means;

mounting a cam element within said cam guide means movably into engagement with the camming surface on said replacement trigger lever; and connecting a pair of linkage members between the remote trigger assembly and the cam element such that said cam element is urged into camming engagement with said camming surface by the linkage members when the remote trigger is pulled, the camming engagement operating to pivot the replacement trigger and thus move the sear sufficiently to release the hammer from a cocked position against the firing pin.

27. The method of claim 26 further comprising the steps of detaching the shoulder stock of the rifle and replacing it with a shorter butt stock.

* * * * *